United States Patent [19]

Young et al.

[11] Patent Number: 4,938,052

[45] Date of Patent: Jul. 3, 1990

[54] CAN CONTAINMENT APPARATUS

[75] Inventors: Kenneth P. Young, Chesterfield; Alan A. Koch, Maryland Heights, both of Mo.

[73] Assignee: Alumax, Inc., Norcross, Ga.

[21] Appl. No.: 883,324

[22] Filed: Jul. 8, 1986

[51] Int. Cl.[5] ..... B21D 37/16; B21D 43/10

[52] U.S. Cl. ..... 72/361; 72/364; 72/422

[58] Field of Search ..... 164/80, 485, 900, 332; 72/342, 361, 364, 422; 29/422, DIG. 47; 148/2

[56] References Cited

U.S. PATENT DOCUMENTS

| | | | |
|---|---|---|---|
| 2,592,172 | 4/1952 | Nippert | 29/597 |
| 3,147,362 | 9/1964 | Ramsey et al. | 29/DIG. 47 |
| 3,633,766 | 1/1972 | Byam | 72/422 |
| 3,657,804 | 4/1972 | Kroch et al. | 29/DIG. 47 |
| 3,902,544 | 9/1975 | Flemings et al. | 164/485 |
| 3,967,485 | 7/1976 | Oguchi et al. | 72/271 |
| 4,491,451 | 1/1985 | Willim | 72/422 |
| 4,569,218 | 2/1986 | Baker et al. | 72/342 |

FOREIGN PATENT DOCUMENTS

| | | |
|---|---|---|
| 1129624 | 8/1982 | Canada . |
| 1136679 | 11/1982 | Canada . |
| 1499934 | 2/1978 | United Kingdom . |

OTHER PUBLICATIONS

M. C. Flemings, R. G. Riek, K. P. Young, "Rheocasting," *Materials Science and Engineering*, vol. 25 (1976), pp. 103–117.

G. B. Brook, "Improving the Quality of Aluminum Die Castings by Novel Techniques," Material Design, Oct., 1982, 3, (5), pp. 558–565.

S. D. E. Ramati, G. J. Abbaschian, D. G. Backman, R. Mehrabian, "Forging of Liquid and Partially Solid Sn–15% Pb and Aluminium Alloys," *Metallurgical Transactions*, vol. 9B, Jun., 1978, pp. 279–286.

*Primary Examiner*—Robert L. Spruill

*Attorney, Agent, or Firm*—Limbach, Limbach & Sutton

[57] ABSTRACT

Shaped metal parts are produced on a continuous basis from semi-solid metal preforms. Plurality of cans, each containing a metal preform, are sequentially heated in an induction heating zone to bring the preforms to a semi-solid level. The preforms can be transformed without loss of any metal or heat to a press where they are shaped in a semi-solid state into a metal part. The can can then be removed and recycled.

1 Claim, 4 Drawing Sheets

CAN CONTAINMENT APPARATUS

TECHNICAL FIELD OF THE INVENTION

The present invention relates to an apparatus for producing shaped metal parts on a continuous basis. The invention is related to the invention disclosed and claimed in U.S. Pat. No. 4,569,218 and is considered an improvement over the invention disclosed therein.

BACKGROUND OF THE INVENTION

Vigorous agitation of metals during solidification is known to eliminate dendritic structure and produce a semi-solid "slurry structured" material with thixotropic characteristics. It is also known that the viscosities of such material may be high enough to be handled as a soft solid. See Rheocasting, Merton, C. Flemings, and Kenneth P. Young, McGraw, Hill, *Yearbook of Science and Technology,* 1977–78. However, processes for producing shaped parts from such slurry structured materials, particularly on a continuous basis, present a number of problems. Such processes require a first step of reheating a slurry structured billet charge to the appropriate fraction of solid and then forming it while in a semi-solid condition. A crucible has been considered essential as a means of containing the material and handling it from its heating through its forming cycle. The use of such crucibles is costly and cumbersome, and furthermore, creates process disadvantages such as material loss due to crucible adhesion, contamination from crucible degradation and unwanted chilling from random contact with crucible sidewalls. Further problems are involved in the heating, transport and delivery of billets which are in a semi-solid condition.

Recognizing that it would be desirable to provide an apparatus and process for producing shaped metal parts from semi-solid preforms, the invention disclosed in U.S. Pat. No. 4,569,218 was made. In accordance with that invention, it was found that it is possible to produce on a continuous basis shaped metal parts from slurry structured freestanding metal preforms by sequentially raising the heat content of the preforms as they pass through a plurality of induction heating zones. The heating sequence is such that it somewhat avoids melting and resulting flow and permits thermal equilibration during transfer from one zone to the next as the preforms are raised to a semi-solid temperature. The invention further provides that the preforms take on the characteristic of being substantially uniformly semi-solid throughout their bodies. The freestanding semi-solid preforms are taught to be transferred to a press or other shaping station by means of a mechanical device which grips the preforms with a very low force, which both prevents substantial physical deformation of the semi-solid preform and reduces heat loss. As a preferred embodiment, U.S. Pat. No. 4,569,218 further teaches that the transfer means may be heated to even further minimize heat loss of the preforms during transfer.

More specifically, the apparatus disclosed in the above-referenced patent comprises, in combination, means for supporting and positioning a plurality of slurry structured freestanding metal preforms which include means for passing the preforms through a plurality of induction heating zones containing induction heating means for sequentially raising the heat content of the preforms while the preforms remain freestanding to a level at which the preforms are semi-solid. Means are then provided for transferring the freestanding preforms from the supporting means to a shaping means while the preforms remain in a semi-solid state, said transfer occurring without substantial deformation of the preforms and without substantial local variation in fraction solids within the preforms. Means are then provided for shaping the preforms while in the semi-solid state into a shaped metal part and means for recovering the solidified shaped metal part.

Although the invention disclosed and claimed in U.S. Pat. No. 4,569,218 is adequate, particularly when dealing with semi-solid preforms of rather small mass, as preform sizes have increased to produce larger and larger shaped metal parts, it was noted that the semi-solid preforms tend to excrete liquid metal. This tendency is particularly noticeable as the preforms pass through multiple induction heating zones and approach the appropriate temperature for shaping into the final metal parts. The loss of liquid can be related to the degree of melting which is induced by the induction heating elements and appears to be relatively unrelated to the rate of heating. Typically, a 1 kg slug of aluminum alloy 357, being of a cylindrical configuration and having a diameter of approximately 2.5" and a length of approximately 5" would lose from 50 to 100 grams of liquid when heated an appropriate amount for shaping into a forged part. This results in upwards of a 10% metal loss. Besides losing a significant portion of each preform, the liquid which emanates from each preform accumulates on the processing equipment, which must be cleaned after each cycle and results in operational inefficiencies.

It is thus an object of the present invention to provide an apparatus related to the invention disclosed and claimed in U.S. Pat. No. 4,569,218 while avoiding the liquid metal losses referred to above.

The accomplishment of this object will be more readily appreciated when considering the following disclosure and appended drawings wherein FIG. 1 is a partial schematic plan view of one embodiment of apparatus useful in the practice of the present invention;

DETAILED DESCRIPTION OF THE INVENTION

The starting preform used in the practice the present invention is a metal alloy, including not limited to such alloys as aluminum, copper, magnesium or iron, which has been prepared in such a fashion to provide a slurry structure. This may be done vigorously agitating the alloy while in the form of a liquid-solid mixture to convert a substantial portion preferably 30%–55% by volume of the alloy to a nonform. The liquid-solid mixture is then cooled to solidify the alloy. Alloys of this nature are generally characterized as possessing a microstructure which, upon to a semi-solid state, contain primary spherical solid particles within a lower melting matrix. Such slurry structured materials may be prepared without agitation by a solid state process involving the production, such as by hot working, of a metal bar or other shape having a directional grain structure and a required level of strain introduced during or subsequent to hot working. Upon reheating such a bar, it will al contain primary spherical solid particles within a lower melting matrix. Yet another method of forming the slurry structured materials by agitation is by use of rotating magnetic field, such as that disclosed in published British Application No. 2,042,386. A preferred method of preparing the preforms is, however, by the solid state process, which is disclosed more fully in U.S. Pat. No. 4,415,374, the disclosure of which is incorporated by reference herein.

An apparatus and process for producing shaped metal parts related to the present invention is in U.S. Pat. No. 4,569,218. The invention disclosed in the referenced patent is taught to be particularly useful for the production of relatively small shaped copper or aluminum alloy parts. It was recognized that beyond a certain size, freestanding preforms become increasingly difficult to handle in a semi-solid condition and, as such, the invention was deemed useful only in the production of relatively small parts. Through the practice of the present invention, however, the size of the preform and resulting finished product is no longer seen as a limiting variable.

Figure 1:
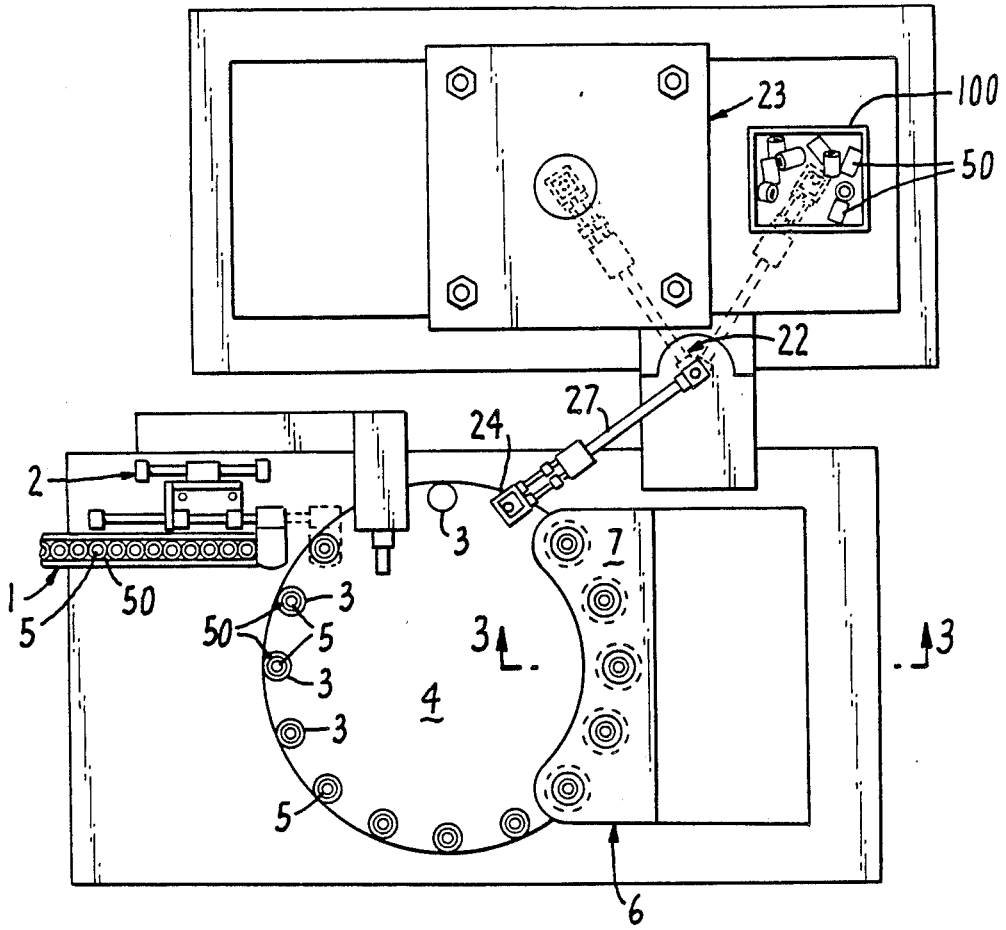

To eliminate the above-referenced difficulties, the apparatus and process described and claimed in U.S. Pat. No. 4,569,218 have been modified by the inclusion of a can-shaped containment means for containing the plurality of metal preforms as they progress through their pre-heating cycle. As shown in FIG. 1, preformed slugs are fed into a stacker 1 as, for example, from a commercially available vibratory bowl feeder (not shown) already placed within individual can-shaped containment means 50. Alternatively, a separate feeding apparatus for the can-shaped containment means could have applied elements 50 to the insulated pedestals 3 on rotatable table 4 in an empty condition for accepting the preformed slugs as they are introduced onto the rotatable table. For the sake of the present invention, it is only required that the preformed slugs be placed within can-shaped container means 50 prior to heating the slugs by induction heater 6 or otherwise.

Figure 4:
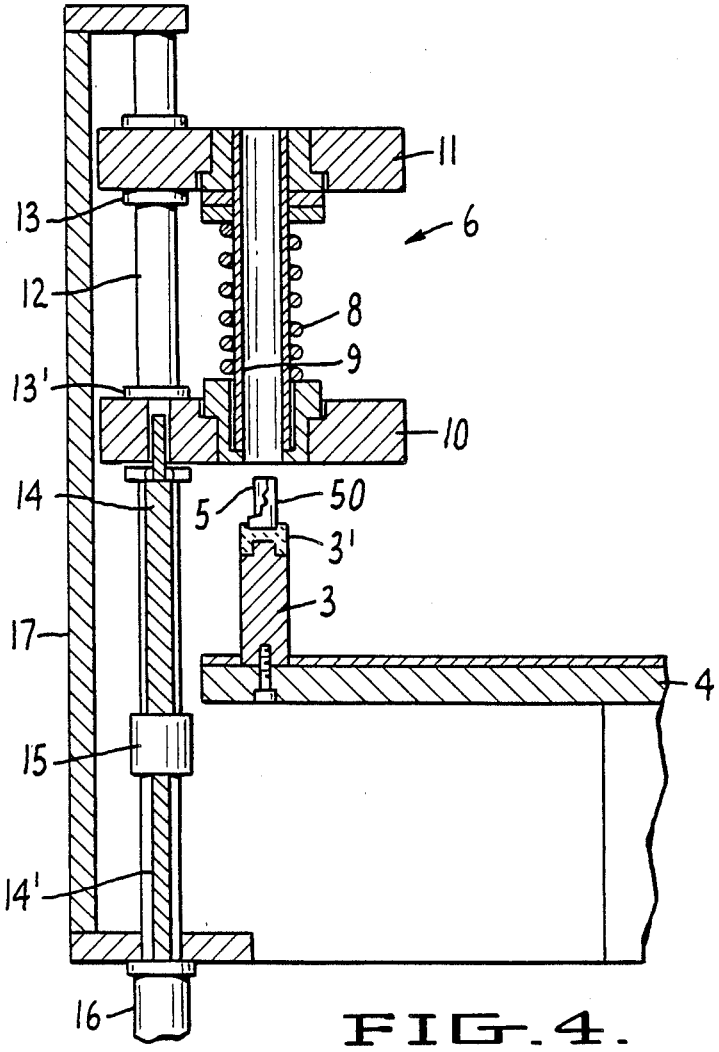
FIG. 4 is a cross-sectional view of the induction heater in an elevated position above the can-shaped containment means taken along lines 3—3 of FIG. 1.

From stacker 1, the can-shaped container means housing individual preformed slugs are lifted by a loading dial 2 and placed onto a pedestal 3 on rotatable table 4, the pedestal, in a preferred embodiment, may have a thermal insulator cap 3' (FIG. 4). The rotatable table contains around its periphery a series of such pedestals, each of which supports and positions a freestanding can-shaped container means containing a preform or slug 5. An induction heater 6 is mounted on an opposite side of rotatable table 4, the induction heater comprising a hood 7 containing a series of coils forming a series of induction heating zones. The induction heater is vertically movable from a first elevated position, as shown in FIG. 4, when table 4 is in the process of being indexed to the next consecutive pedestal position to a second descended position in which the induction heating zone encloses a series of adjacent can-shaped containment means housing metal preforms 5 so as to raise the heat content of the metal preforms. During this period, the horizontal center line of the preforms should be below the center line of the coils of the induction heater to avoid levitation of the preforms. Each of the induction heating zones heats the adjacent preforms to a sequentially higher level in the direction of movement of table 4 so that the preform about to emerge from the induction heater, i.e., in its final position in the heater, is in a uniformly semi-solid condition, preferably 70–90% by volume solids, remainder liquid. In the invention taught in U.S. Pat. No. 4,569,218, it was recited to be necessary to provide a specific relationship between the rate of heating within the various induction coil members as the preforms approach their final softened state to avoid liquid metal flow problems. However, through the use of the can-shaped containment means of the present invention, it is substantially unnecessary to shorten the total time at final temperature, as liquid flow would simply be captured by the inner walls of the can-shaped containment means.

A first attempt to provide appropriate container means centered about the use of a refractory (ceramic) material for capturing the liquid metal. Such material, was non-electrically conductive so that it did not interfere with the induction heating process. However, such materials are costly, prone to damage, and are difficult to clean. As such, it is the intent of the present invention to employ a can-shaped containment means which is composed primarily of metal, which possesses sidewalls which are thin enough to be substantially electrically transparent to the induction field employed by the heating elements, and yet not contaminate the preformed slugs. Selection of materials for fabricating the can-shaped containment means is predicated upon the composition of the alloy to be heated as well as the frequency of the induction coil to which the can-shaped containment means is to be substantially transparent. For example, initial tests utilized aluminum foil having a thin gauge and melting point somewhat higher than the preform alloy, namely, 357 aluminum alloy. The tests showed that the concept was feasible in that the foil did not heat, but contact with the liquid metal caused the foil to dissolve toward the end of the heating cycle. Subsequently, tests were successful with increasingly rigid aluminum cans, exhibiting minimum contact with the liquid metal. For an aluminum can, best results were achieved when the induction coil operated between 1,000 and 3,000 Hz. When the frequency approached 10,000 Hz, even the thinnest aluminum tended to heat. However, at all frequencies it was a remarkable observation that in the absence of a preform within the can, all cans tended to overheat.

The selection of wall thicknesses of the can-shaped containment means is made with the electrical resistivity and magnetic permeability of the wall and frequency of the induction heating means as variables. As such, wall thicknesses, which are somewhat "transparent" to the induction heating means when the can-shaped containment means houses a preform ingot to be heated, are governed by the following relationship:

$$\text{Maximum wall thickness } \delta = \sqrt{\frac{\rho^2}{\mu_2 f}} \text{ inches}$$

For aluminum can-shaped containment means, the optimum wall thickness was calculated as being approximately 0.030 inches or less in a 3000 Hz field. For non-magnetic austenitic stainless steel wall thickness should ideally be less than 0.155 inches to maintain "transparency" when loaded with an aluminum preform ingot.

Beyond the use of aluminum as an excellent choice for the can-shaped containment means, stainless steel remains a very good containment material. Stainless steel is attractive as a choice due to its favorable high temperature properties while its oxidized surface is somewhat resistant to adhesion by aluminum, particularly in its semi-solid condition.

Turning again to the appended figures, the induction heater is shown in greater detail in the cross-sectional view of FIG. 4. As there shown, the induction heater 6 comprises series wound induction coil 8, having a ceramic liner 9 mounted in a phenolic rack having a bottom support 10 and a top support 11. The heater 6 is in turn mounted for vertical movement on a post 12 via bearings 13 and 13'. Extension rods 14 and 14' are coupled through coupler 15 to an air cylinder 16 for raising and lowering the induction heater 6 about can-shaped containment means 50. The entire assembly is mounted in a frame 17.

Figure 2:
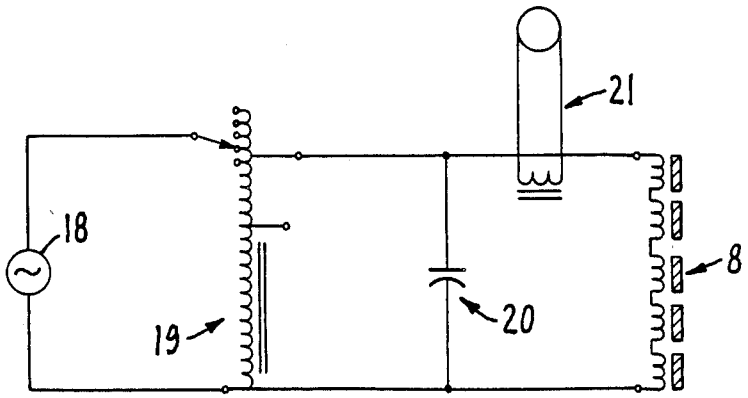
FIG. 2 is a diagram of an electrical circuit for the induction heater shown in FIGS. 1 and 4.
Figure 3:
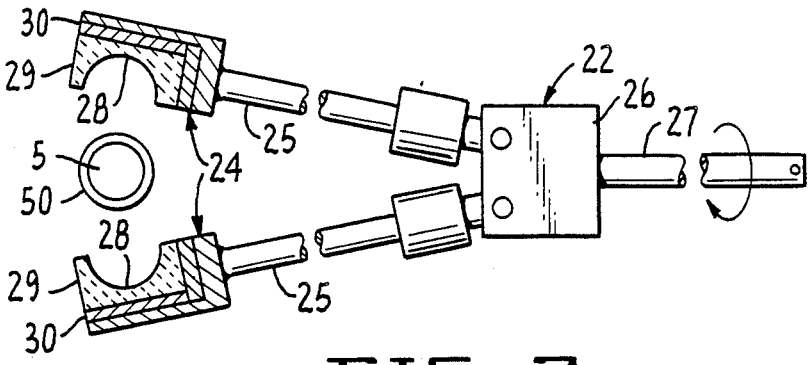
FIG. 3 is an enlarged plan view of the mechanical gripper shown in FIG. 1.

A typical circuit diagram for the induction heater 6 is shown in FIG. 2. As there shown, a high frequency alternating current power source 18 supplies current through a load station consisting of a primary transformer 19, parallel tuning capacitors 20, and an output current transformer 21 to the induction heater 6, comprising five induction coils 8 connected in series. Direct-current heating is also contemplated as an appropriate mode of raising the temperature of preform 5.

After the table is indexed, a can-shaped containment means bearing a preform is moved from its final position in the heater to a first position external to the heater, where a pair of grippers 22 mechanically grips and removes the can-shaped containment means from its pedestal and rotates to a position aligned with a die of a press 23. At that point grippers 22 can be actuated to open, thereby releasing can-shaped containment means 50 onto the plates of the press. To minimize entrapment of the can-shaped containment means in the final metal part, a hole can be established within the base of the can-shaped containment means 50 which is centrally located to provide a ledge over which the preform would reside. Thus, liquid metal which was excreted from the preform would be prevented from leaking from the can-shaped containment means by the preform body itself, but once the ram began to apply pressure to the preform, being thixotropic, it would flow through the opening in the can-shaped containment means body to be discarded as part of residue 70 (FIG. 5C).

As an alternative and preferred embodiment, shaft 27 could be caused to rotate about its longitudinal axis so that can-shaped containment means is inverted 180°, causing the preform to empty onto the plates of the press where the preform in its semi-solid and liquid states is shaped into a metal part. As a preferred embodiment, the grippers are designed to minimize the heat transfer from the preform through the can-shaped containment means sidewalls to the transferring means.

Grippers 22 comprise a pair of gripping jaws 24 attached to gripper arms 25. The gripper arms are pivotally mounted for adjustment of the distance therebetween on a gripper actuator 26 which may be an air powered cylinder. The actuator is in turn pivotally mounted on a suitable support through the actuator arm 27 for transferring the can-shaped container means from the table 4 to press 23. The surface 28 of the gripper jaws is machined from any appropriate material such as stainless steel or refractory block to have a contour closely matching the contour of the can-shaped container means 50. Although not essential when employing can-shaped containment means, a thermal barrier 30 can be sandwiched between the block 29 and gripper jaw 24.

Figure 5A:
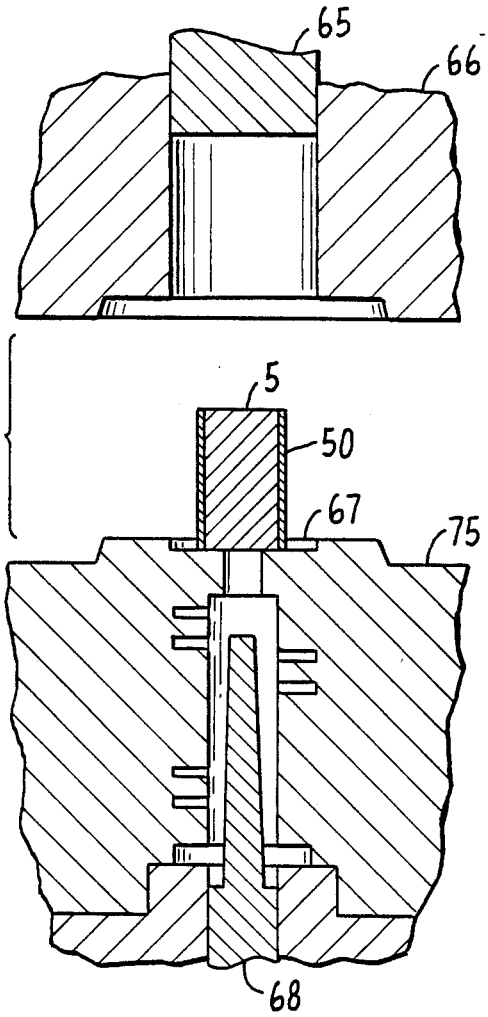
FIG. 5A and 5B are cross-sectional views of a typical metal part forming ram wherein the can-shaped containment means is not removed prior to part formation.
Figure 5B:
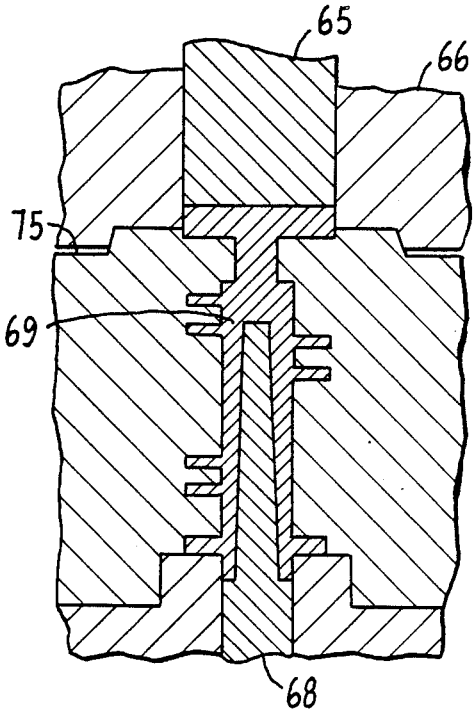
Figure 5C:
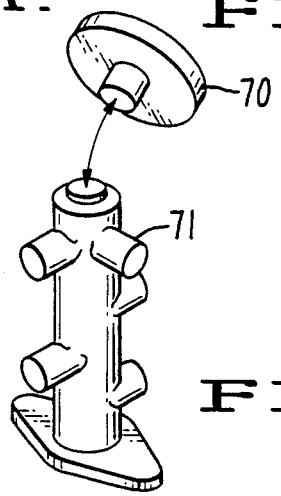
FIG. 5C is a view of the product produced in FIGS. 5A and 5B.

One of the embodiments of the present invention can be visualized by reference to FIGS. 5A through 5C. More specifically, can-shaped containment means 50 is shown in FIG. 5A after having been placed upon press 75. Thereupon, upper press surface 66, housing ram 65, lowers upon can-shaped containment means 50, which contains preform 5 in a semi-solid state. Ram 65 then proceeds down the inner wall of upper element 66 to compress and extrude preform 5 around die 68 to form the desired metal part.

In the embodiment illustrated in FIG. 5, it is noted that can-shaped containment means 50 actually becomes a portion of the finished part. In effect, can-shaped containment means is a contaminant of the finished part which resides entirely within chamber 67 (FIG. 5A) and thus can be discarded as waste 70, leaving finished part 71 composed entirely from semi-solid preform 5.

Figure 6A:
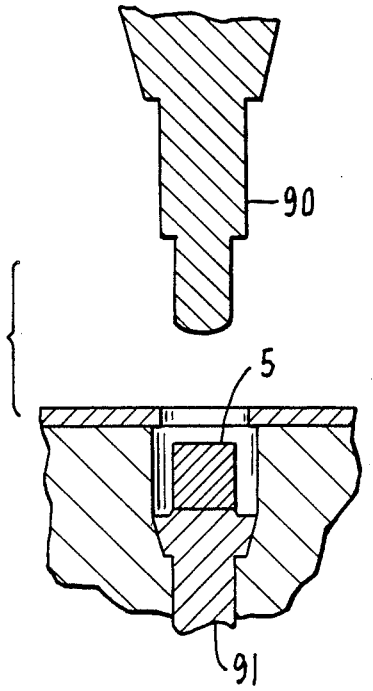
FIGS. 6A and 6B are cross-sectional views of a typical metal part forming ram wherein the can-shaped containment means has not been made a part of the metal shaped product.
Figure 6B:
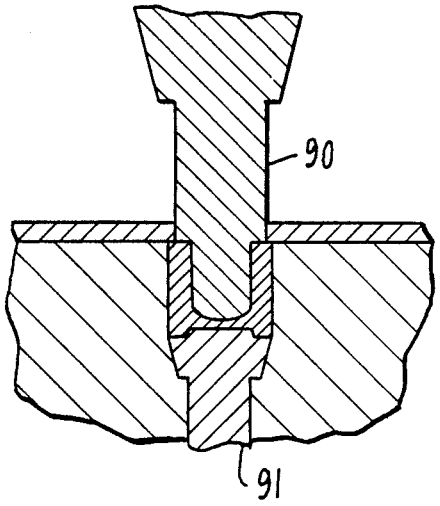
Figure 6C:
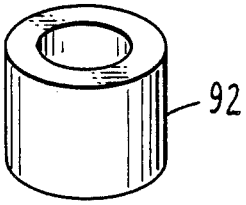
FIG. 6C is a view of the product produced in FIGS. 6A and 6B.

As an optional embodiment, gripping jaws 24 can maintain their gripping contact upon can-shaped containment means 50 after preform 5 has been introduced to the die of the press used to make the final metal part. In this embodiment, shown in phantom in FIG. 1 as well as by reference to FIG. 6, the gripper jaw assembly can be caused to continue its rotation in a clockwise direction after preform 5 has been deposited. When reaching holding area 100 gripping contact is released and the deposit of can-shaped containment means 50 is made. As such, only preform 5 is introduced onto die 91, whereupon ram or punch 90 is caused to shape finished metal part 92. In employing such an embodiment, the can-shaped containment means can be recycled for further use and there is no need to remove contaminant 70 from the finished product. With regard to the embodiments shown ranging from 1 to 500 tons equipped with dies appropriate to the part being shaped. The press may be actuated by a commercially available hydraulic pump sized to meet the tonnage requirements of the system. Suitable times, temperatures and pressures for shaping parts from slurry structured metals are disclosed in Canadian Pat. No. 1,129,624, issued on Aug. 17, 1982.

The induction heating power supply for the system may range in size from 1 to 1000 kw and may operate at frequencies from 60 to 400,000 Hz. The precise power capability and frequency are selected in accordance with the preform diameter, heating rate desired, and composition of the can-shaped containment means. Typically, for example, the power requirement may range from ¼ to 1 kw per pound per hour of production required.

Example

One kg slugs having the dimension of 2.5" in diameter by 5" in length made of 357 aluminum alloy were loaded into open ended can-shaped aluminum alloy containment means having a sidewall gauge of approximately 0.006" to 0.009". The loaded containment means were placed upon pedestals on a 16-station rotary indexing table of the type shown in FIG. 1. The slugs and can-shaped containment means were transported from station to station by rotation of the table and pedestals at a rate of 4 indexes per minute. For ten consecutive stations the pedestals were surrounded by induction coils raised and lowered in sequence with the index motion so that in the stationary periods the horizontal center lines of the slugs were located below the center line or mid-height of each coil. A coil current of approximately 600 amps at 1000 Hz was employed wherein after 10 cycles the slugs were semi-solid. The can-shaped containment means remained solid and provided a surface upon which gripper 24 could grasp. The can-shaped containment means containing the semi-solid slug was then transported to the die, inverted and released. As the press operated at a ram velocity of 12" per second, the slug was extruded into the die and, after metal part formation, the can contaminant removed as depicted in FIG. 5.

We claim:

1. A method for continuously producing shaped metal parts comprising:

A. providing can-shaped containment means for containing metal preforms;

B. introducing metal preforms into the can-shaped containment means;

C. introducing the can-shaped containment means containing said metal preforms into one or more heating stations such that said preforms become partially liquid and partially solid;

D. transferring said can-shaped containment means containing said preforms from said heating stations to a shaping means while said preforms remain substantially in their partially liquid and partially solid states;

E. introducing both the can-shaped containment means and the preforms into the shaping means; and F. shaping said preforms while in their partially liquid and partially solid state into shaped metal parts wherein the can-shaped containment means is deformed by said shaping means and is removed from the shaped metal part as an impurity.

* * * * *